United States Patent [19]

Asick et al.

[11] Patent Number: 4,738,637

[45] Date of Patent: Apr. 19, 1988

[54] RECEPTACLE ASSEMBLY WITH GROUND PLANE SPRING

[75] Inventors: John C. Asick, Harrisburg; John M. Landis, Camp Hill; Clair W. Snyder, Jr., York, all of Pa.; Leon T. Ritchie, Clearwater, Fla.

[73] Assignee: AMP Incorporated, Harrisburg, Pa.

[21] Appl. No.: 786,442

[22] Filed: Oct. 11, 1985

[51] Int. Cl.[4] ..... H01R 13/648

[52] U.S. Cl. ..... 439/610

[58] Field of Search ..... 339/14 R, 143 R; 174/35 R, 6 C; 439/607, 610, 855

[56] References Cited

U.S. PATENT DOCUMENTS

| | | | |
|---|---|---|---|
| 4,386,814 | 6/1983 | Asick | 339/143 R X |
| 4,571,012 | 2/1986 | Bassler et al. | 339/143 R X |
| 4,601,527 | 7/1986 | Lemke | 339/14 R |
| 4,655,518 | 4/1987 | Johnson et al. | 339/17 LC |

FOREIGN PATENT DOCUMENTS

| | | | |
|---|---|---|---|
| 2122038 | 1/1984 | United Kingdom | 339/143 R |

*Primary Examiner*—Eugene F. Desmond

*Attorney, Agent, or Firm*—F. Brice Faller; David L. Smith

[57] ABSTRACT

Shroud assembly for mounting to a panel opening includes a ground plane spring manufactured in continuous strip form. Individual spring strips are severed from the continuous strip and sandwiched between sidewalls of the shroud and a rim member. First spring fingers extend into the cavity which receives the connector and second spring fingers extend through apertures in the rim member to bear against the panel. Pegs on the sidewalls cooperate with holes in the strips and the rim member.

15 Claims, 5 Drawing Sheets

RECEPTACLE ASSEMBLY WITH GROUND PLANE SPRING

The present invention relates to a receptacle assembly having a metal ground plane spring to provide continuity between a shielded connector and a metal panel.

U.S. Pat. No. 4,386,814 discloses a receptacle assembly for mounting to a panel in alignment with an opening therethrough. The assembly is of the type comprising shroud means having sidewalls defining a connector receiving cavity, the sidewalls having respective top surfaces which are substantially coplanar, and ground plane spring means on the shroud means.

The ground plane spring means is stamped and formed as a single piece spring having a central aperture and first spring fingers about the periphery of the aperture formed to extend into the cavity. Second spring fingers about the outer periphery are formed only slightly from the plane thereof to bear against the panel.

The above described spring is typical of those used with shrouds in backplane connectors, and requires a different stamping for different shrouds, as required by different pin arrays and their complementary connectors.

SUMMARY OF THE INVENTION

According to the invention, therefore, a receptacle assembly as described above is characterized by a metal spring strip on each sidewall, each strip having a web received against the top surface, a first edge of the web flanking the cavity. A plurality of first fingers extend from the first edge at regular intervals along the length of the strip, the first fingers being formed to extend into the cavity away from the plane of the top surfaces. A plurality of second spring fingers extend from the first edge along the length of the strip alternately with the first fingers, the second fingers being formed away from the first fingers and back toward the web. Electrical continuity is thus provided between a shielded connector engaged by the first fingers and a panel engaged by the second fingers.

The chief advantage of the invention, is that the spring strips are manufactured in a continuous strip. The strip is severed at desired intervals to yield individual strips of the desired lengths, which lengths are determined by the size of the shroud to which they are fixed. The continuous strip thus serves as a universal ground plane spring, and obviates the need for stamping different size springs for different size connectors.

Since the second spring fingers are formed to lie over the web, they do not extend beyond the shroud and thus the shrouds may be more closely spaced than in the prior art. Also, since the fingers are stamped from the same edge of the web, less scrap is produced.

DETAILED DESCRIPTION OF THE PREFERRED EMBODIMENT

Figure 1:
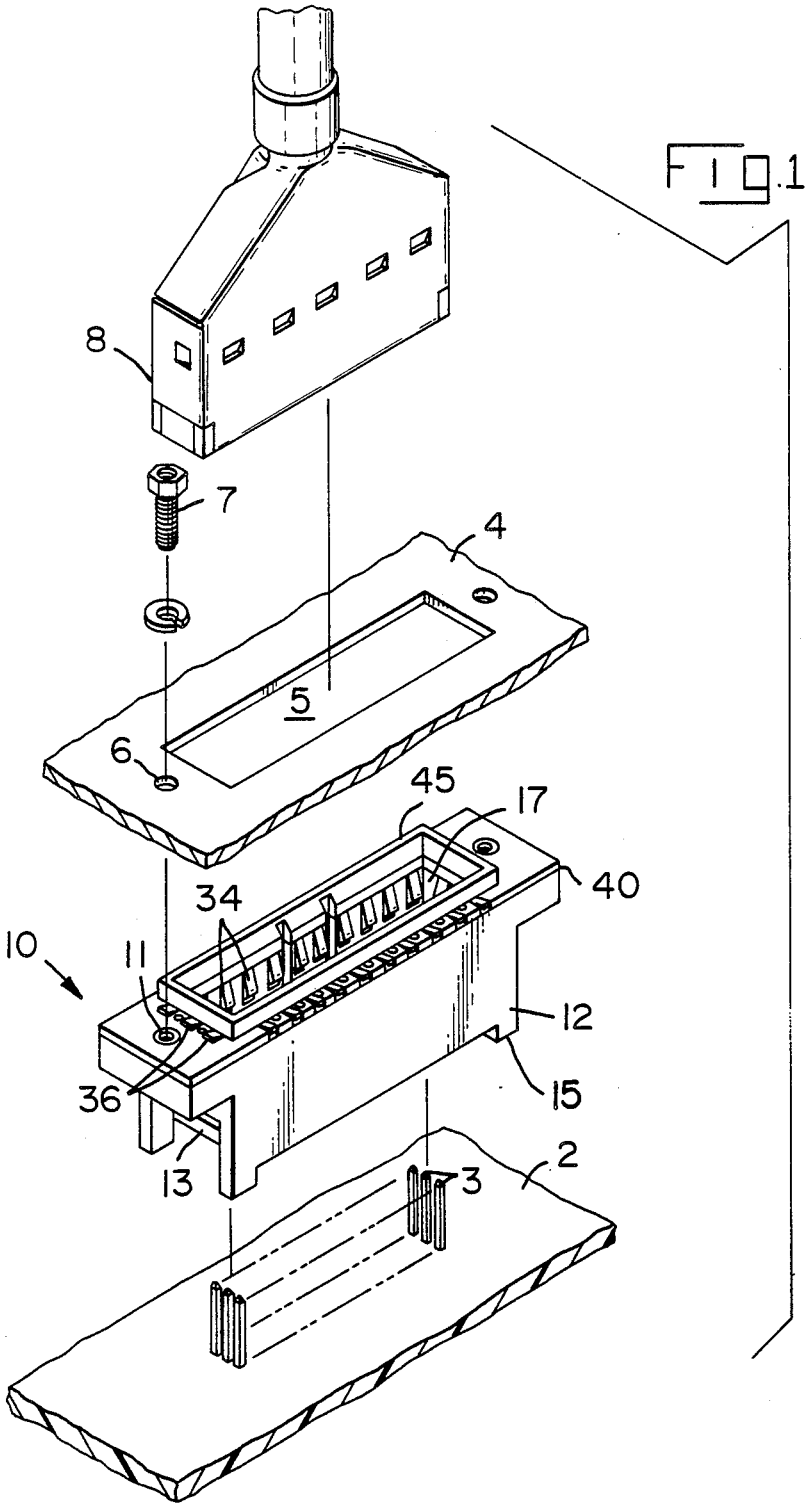
FIG. 1 is a perspective of the backplane, the receptacle assembly, the panel, and the mating connector.

Referring to FIG. 1, the shroud assembly 10 comprises a shroud 12 and a rim member 40. The shroud 12 has a cavity 17 which receives pins 3 upstanding from a backplane 2, and the rim member 40 has an upstanding lip 45 which is closely received in aperture 5 of metal panel 4. Ground plane spring means comprises first spring fingers 34 which contact a shielded connector 8 received in cavity 17, and second spring fingers 36 which bear against panel 4 to ground the shielding of connector 8. Threaded inserts 11 receive screwlocks 7 through holes 6 to retain the assembly 10 to panel 4. Note that while a shroud 12 receiving pins 3 is depicted, the invention also contemplates substitution of a pin header or other receptacle means therefor.

Figure 2:
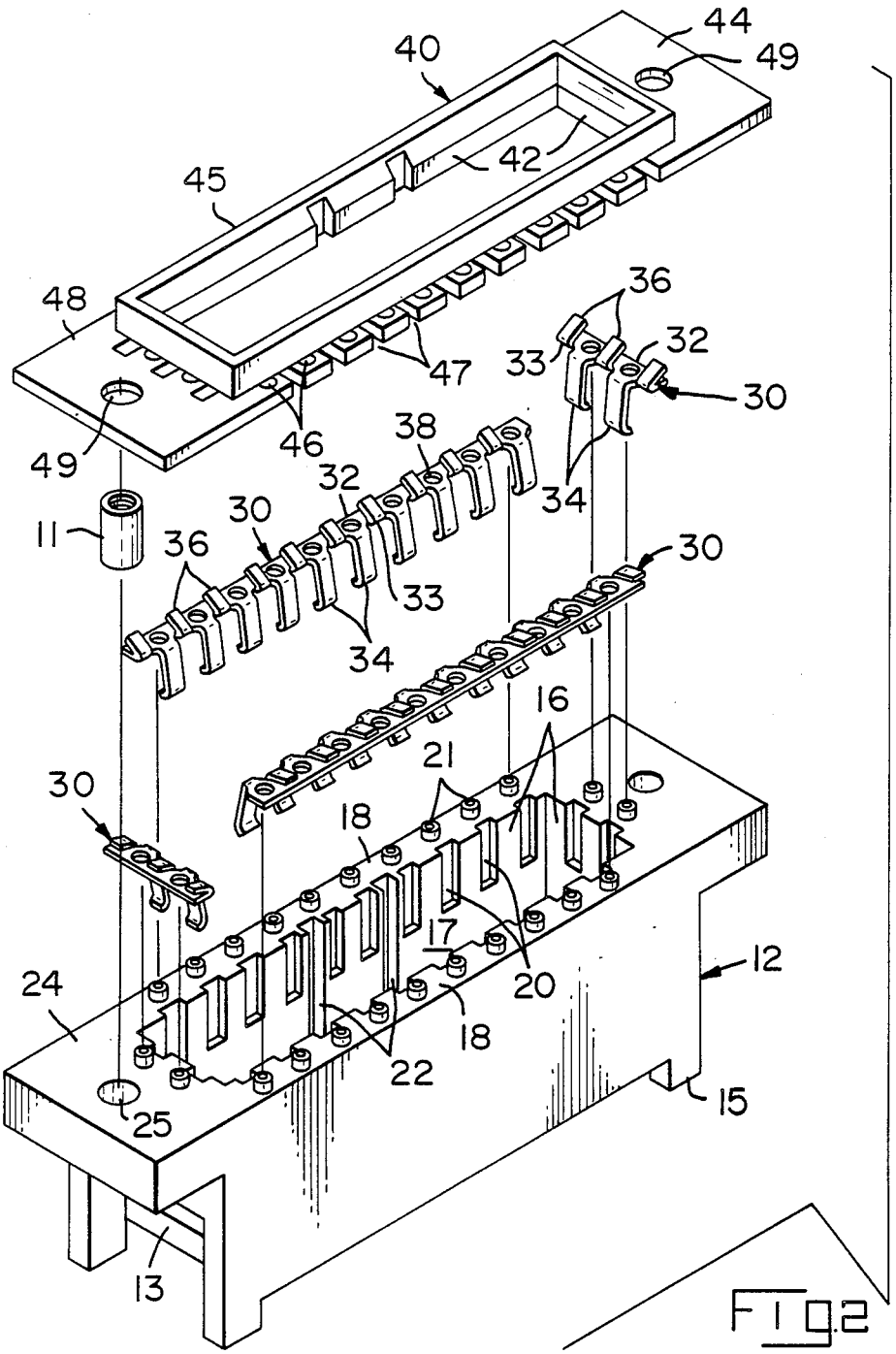
FIG. 2 is an exploded perspective of the receptacle assembly.
Figure 3:
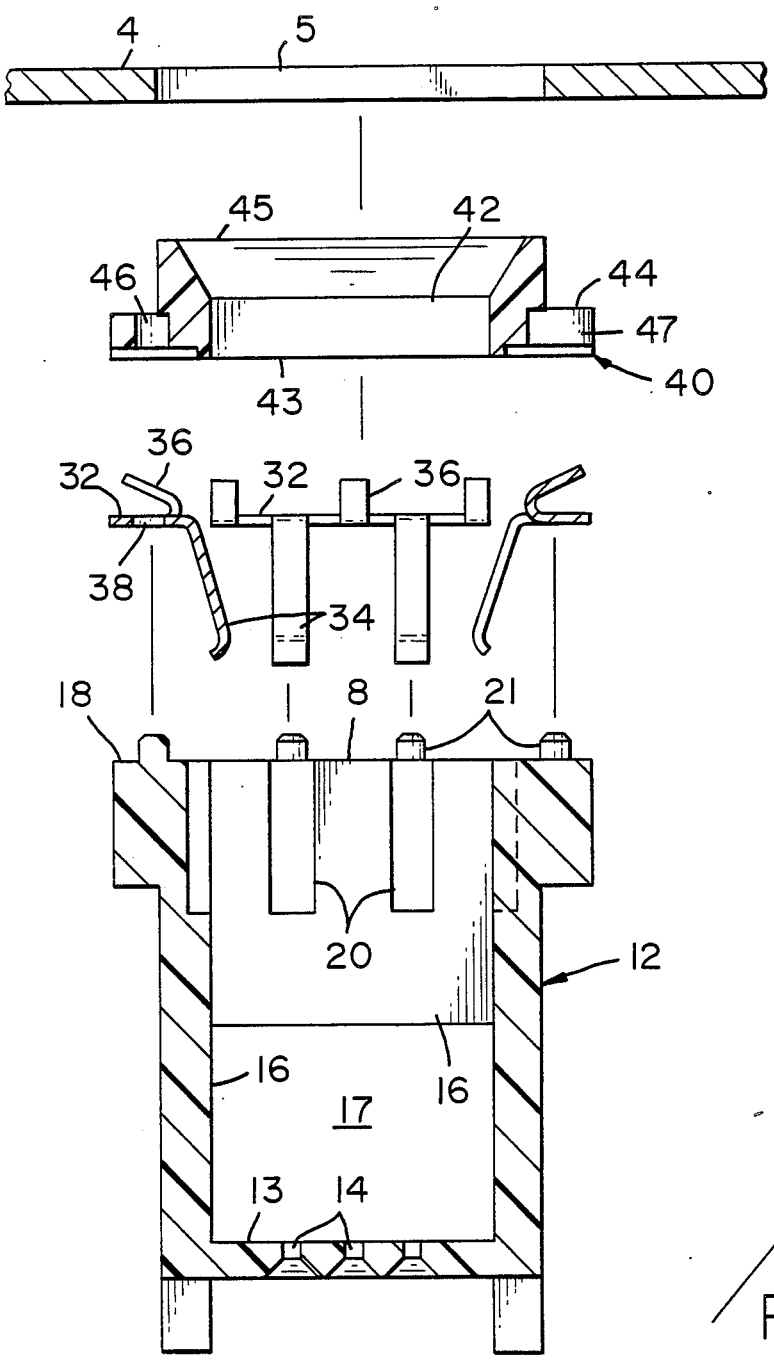
FIG. 3 is an exploded end section of the receptacle assembly.

Referring also to FIGS. 2 and 3, the shroud 12 comprises a base 13 having pin receiving apertures 14, and four sidewalls 16 upstanding therefrom to define a rectangular cavity 17. The sidewalls 16 have respective top surfaces 18 which are substantially coplanar, and a plurality of channels 20 extending therefrom into cavity 17. The sidewalls 16 at opposite ends are recessed toward the top surfaces to provide clearance for an array of pins extending beyond the base 13. Standoffs 15 allow space below base 13 for wire-wrap termination of posts 3. Pegs 21 provide aligning means for the rim member 40, and slots 22 provide polarization means for connector 8 (FIG. 1). Flanges 24 have holes 25 in which the threaded inserts 11 are heat staked or otherwise secured.

Metal spring strips 30 are stamped and formed from metal strip stock having good spring properties, such as bronze, and are tin plated. Each strip 30 comprises a web 32 having a first edge 33 from which first spring fingers 34 extend alternately with second spring fingers 36 at regular intervals. The first fingers 34 are formed through about 75 degrees from the web 32, while the second spring fingers 36 are formed oppositely through about 165 degrees to lie 15 degrees off the web 32. Holes 38 punched in the strip at regular intervals not only provide indexing means during the forming operations, but also cooperate with pegs 21 to situate the web 32 on the respective top surface 18, thus assuring that fingers 34 are aligned with respective channels 20. The rim member 40 has four sidewalls 42 defining a rectangular aperture of like profile as cavity 17, a bottom surface 43 received against web 32, and a top surface 44 received against panel 4. Holes 46 receive pegs 21 extending through web 32 and align second fingers 36 with slots 47 between surfaces 43, 44. Flanges 48 have holes 49 into which inserts 11 extend, providing initial aligning means during assembly.

Figure 4:
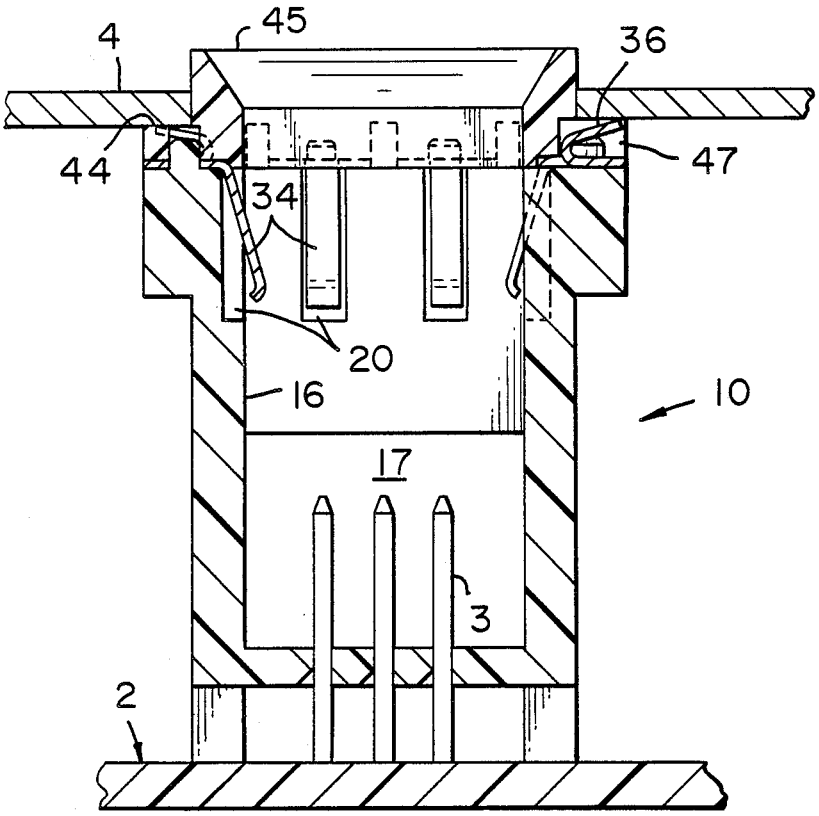
FIG. 4 is an end section of the assembly as mounted to a backplane and a panel.

FIG. 4 shows the assembly 10 sandwiched between backplane 2 and metal panel 4. The first spring fingers 34 protrude above the inside surfaces of sidewalls 16, and deflect into respective channels 20 when a connector 8 (FIG. 1) is inserted in cavity 17 to mate with posts 3. The fingers 34 are protected in channels 20 and thus cannot be overstressed. The second fingers 36 deflect into slots 47 when the top surface 44 is placed against the panel 4.

Figure 5:
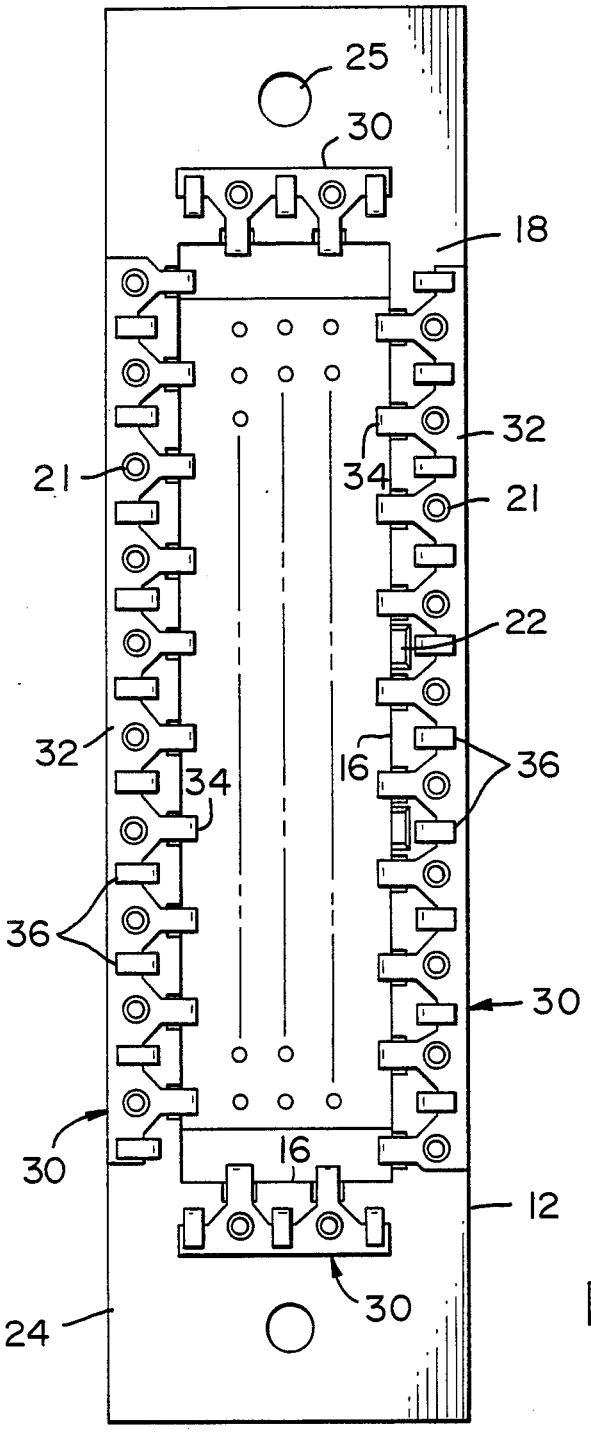
FIG. 5 is a top view of the spring strips assembled to the shroud.

FIG. 5 shows four spring strips 30 assembled to respective sidewalls 16 of shroud 12. The individual strips 30 are all severed from a continuous strip at intervals necessary to provide a four-piece ground plane spring resembling a gasket. The severing points are determined by the size and arrangement of the pin array, as well as the complementary connector mated thereto, which of course determines the size and shape of the shroud.

The foregoing is exemplary and not intended to limit the scope of the claims which follow.

We claim:

1. A receptacle assembly for mounting to a panel in alignment with an opening therethrough, comprising:

housing means having sidewalls defining a connector receiving cavity, the sidewalls having respective top surfaces which are substantially coplanar;

ground means on the housing means, the ground means having metal spring means on at least one of the sidewalls extending continuously along the length thereof, the spring means having a planar web received adjacent the top surface, first spring finger means extending from the web, the first spring finger means being formed to extend into the cavity away from the plane of the top surfaces, second spring finger means extending from the web along the length of the spring means, the second spring finger means being formed away from the first spring finger means, such that electrical continuity is provided between a shielded connector engaged by the first finger means and a panel engaged by the second finger means; and retention means provided on the housing means to cooperate with the spring means to align the spring means in the aassembly until such time as the panel is secured to the assembly, which in turn secures the spring means in position.

2. A receptacle assembly as in claim 1 wherein said sidewalls are profiled with channels which extend into said cavity from said top surface, said first spring fingers extending into respective channels.

3. A receptacle assembly as recited in claim 1 further comprising a rim member received against the web, said rim member having aperture means which receive said second spring fingers.

4. A receptacle assembly as in claim 3 wherein said rim member has about its inner periphery an upstanding lip profiled for reception in said panel opening.

5. A receptacle assembly as recited in claim 1 wherein the planar web is received against the top surface of the sidewalls.

6. A receptacle assembly as recited in claim 1 wherein a plurality of first spring finger means extends from a first edge of the web at regular intervals along the length of the spring means.

7. A receptacle assembly as recited in claim 6 wherein a plurality of second spring finger means extend from the first edge along the length of the spring means alternately with the first fingers, the second finger means are bent back toward the web.

8. A receptacle assembly as recited in claim 1 wherein the housing means further comprises peg means extending from the top surface of each sidewall, the spring means further comprises a series of holes punched in the web at regular intervals, the peg means being received through respective holes.

9. A receptacle assembly as recited in claim 8 wherein a rim member is received against the web, the rim member having holes which receive respective peg means therein.

10. Electrically conductive ground means manufactured as a continuous strip and adapted to be severed to predetermined lengths and incorporated in a receptacle assembly for mounting to a conductive panel in alignment with an opening therethrough, the opening having major sides and minor sides, the ground means for making electrical contact between the conductive panel around the periphery of the opening and the shield of a shielded connector received in a cavity of the receptacle assembly, said ground means severed to predetermined lengths substantially the length of the major and minor sides of the opening, said ground means comprising:

a planar web having edge means;

first spring finger means extending from said edge means of said web and formed out of the plane of said web in a first direction; and second spring finger means extending from said edge means of said web and formed out of the plane of said web in a second direction, said second spring finger means folded back toward said web, whereby when said ground means is incorporated as part of the receptacle assembly mounted to the conductive panel in alignment with the opening therethrough, said first spring finger means extend into the cavity of the receptacle assembly to engage the shield of the shielded connector received in the cavity and said second spring finger means engage the panel around the periphery of the opening.

11. Ground means as recited in claim 10 wherein each predetermined length contains at least one first spring finger means and at least one second spring finger means.

12. Ground means as recited in claim 10 wherein said first spring finger means are formed through about 75 degrees from the plane of said web and said second spring finger means are formed through about 165 degrees from the plane of said web to lie about 15 degrees off of said web.

13. Ground means as recited in claim 10 further comprising retention means on said web to cooperate with complementary retention means in the receptacle assembly to position said web in the receptacle assembly during assembly thereof.

14. Ground means as recited in claim 10 wherein a plurality of first spring finger means extend from said edge means of said web at regular intervals along a predetermined length of said ground means.

15. Ground means as recited in claim 14 wherein a plurality of second spring finger means extend from said edge means of said web along a predetermined length of said ground means alternately with said first spring finger means.

* * * * *